United States Patent [19]

Krusmark

[11] 4,379,498

[45] Apr. 12, 1983

[54] SAFETY DEVICE FOR LADDERS

[76] Inventor: Richard H. Krusmark, 812 Pembroke Ave., Wabasha, Minn. 55981

[21] Appl. No.: 278,988

[22] Filed: Jun. 30, 1981

Related U.S. Application Data

[63] Continuation-in-part of Ser. No. 129,118, Apr. 21, 1980, abandoned.

[51] Int. Cl.[3] ..... E06C 7/48

[52] U.S. Cl. ..... 182/107; 182/206; 182/214

[58] Field of Search ..... 182/107, 108, 111, 214, 182/206, 93; 248/210, 230, 216.1, 217.3, 219.4

[56] References Cited

U.S. PATENT DOCUMENTS

| | | | |
|---|---|---|---|
| 513,920 | 1/1894 | Guste | 182/214 |
| 910,639 | 1/1909 | Burn | 182/214 |
| 1,994,369 | 3/1935 | Risser | 182/206 |
| 2,808,975 | 10/1957 | Palmquist | 182/107 |
| 3,037,579 | 6/1962 | Barrow | 182/214 |
| 3,336,999 | 8/1967 | McSwain | 182/206 |
| 3,407,900 | 10/1968 | Hopfeld | 182/206 |
| 3,715,012 | 2/1973 | Perry | 182/214 |
| 3,792,756 | 2/1974 | Kelly | 182/107 |
| 3,828,889 | 8/1974 | Rehm | 182/107 |
| 4,090,587 | 5/1978 | Pyle | 182/206 |

FOREIGN PATENT DOCUMENTS

| | | | |
|---|---|---|---|
| 197221 | 5/1923 | United Kingdom | 182/206 |

*Primary Examiner*—Reinaldo P. Machado
*Attorney, Agent, or Firm*—Merchant & Gould

[57] ABSTRACT

A safety device for ladders to prevent slippage when placed against a tree or pole is disclosed. Means for gripping the tree is connected to a holding member A and lies generally perpendicular to the rungs L of the ladder. The holding member A is rotatably fastened to the top rung of the ladder for rotational movement about a longitudinal axis of the rung. In a preferred embodiment, the gripping means comprises a plurality of sharp teeth B disposed along the side edges of the holding member A. The holding member A is arcuately shaped for conforming engagement with the tree when the tree has such a small diameter that the teeth B do not engage the tree. In another embodiment, the holding member A is rotatably fastened to an elongate member C. The elongate member C is then fastened to the side rails I of the ladder generally parallel to the rungs L.

21 Claims, 6 Drawing Figures

SAFETY DEVICE FOR LADDERS

BACKGROUND OF THE INVENTION

This is a continuation-in-part of application Ser. No. 129,118, filed Apr. 21, 1980 and now abandoned.

FIELD OF THE INVENTION

The present invention relates to safety devices for ladders, and more particularly to safety devices adapted to secure the top end of the ladder to a pole or tree.

DESCRIPTION OF THE PRIOR ART

When a ladder having a pair of laterally spaced side rails joined by rungs is placed in engagement with a flat object such as a side of a building, the upper end of the ladder is supported by the upper portion of both side rails. These two points of support provide a relatively stable support. However, when the ladder is placed in engagement with a rounded object such as a pole or a tree, only one point on the upper rung engages the rounded object. With only this single point of support, the ladder tends to tip or rock, whereby the ladder and person may fall. This problem is further compounded when the ladder is placed on soft ground so that one side rail may sink into the ground. This sinking movement of the ladder combined with the one point source of support of the top rung, may also cause the ladder and person to fall.

Various types of devices have been developed for attachment to the upper ends of a ladder to secure the ladder when it is resting against a pole or tree. Such devices are generally known in the art and can be generally classified into three major classifications.

The first general classification includes those safety devices having a flexible member supported between the two side rails of a ladder. The flexible member adapts to the curved surface of the pole or tree, thus offering a considerable area of contact against any slippage. The flexible member may also have a roughened friction surface which further aids in preventing slippage. This classification of safety devices only provides for support along a portion of a circumference of the pole or tree.

The second general classification includes those safety devices having a rigid member suspended between the two side rails of the ladder. The rigid member is either in a generally V-shape or arcuate shape. This rigid member engages the pole or limb around a portion of its circumference, and provides for at least two areas of contact around the circumference of the pole or tree. This classification of safety devices relies on a frictional fit around the circumference of the pole or tree.

A third general classification of safety devices includes those devices having a member with an arcuate indentation between the two side rails of the ladder. The edge of the arcuate indentation is preferably serrated to provide a plurality of relatively sharp, pointed teeth with which to engage the pole or tree about a portion of its circumference.

The safety devices in all three of the classifications have a disadvantage in that they substantially grip the pole or tree only around its circumference or a portion thereof. Ladders equipped with such safety devices are still susceptible to a twisting motion if the area of contact between the safety device and the pole or tree slips around the circumference of the pole or tree. Such a slippage will cause the ladder to tilt from its horizontal position and possibly cause the ladder and person to fall. Also, all three classifications have a disadvantage in that their effectiveness is for trees having a diameter that will fit between the side rails and be engaged by the arcuate or V-shape.

The present invention addresses the problems of the prior art devices and provides for a safety device which may be an attachment for ladders or incorporated within the ladder when it is manufactured to securely fasten the ladder when it is placed against a pole or a tree.

SUMMARY OF THE INVENTION

The present invention is a safety device for ladders having a pair of spaced side rails joined by spaced rungs to prevent slippage when placed against a cylindrical object such as a pole or a tree. The safety device has a holding member. Means for gripping a cylindrical object is connected to the holding member. The gripping means is disposed to lie generally perpendicular to the rungs. The holding member is rotatably fastened to the top rung of the ladder, for rotational movement about a longitudinal axis of the rung. In a preferred embodiment, a plurality of sharp pointed teeth are disposed along the side edges of the holding member. When the ladder is placed against a vertically positioned object, the teeth engage the object along a length generally parallel to a longitudinal axis of the cylindrical object. In a preferred embodiment, the holding member is arcuately shaped, curved generally along a longitudinal axis of said holding member, having a convex shape facing the rung, for conforming engagement with the cylindrical object. This provides for support for the ladder when the cylindrical object has such a small diameter that the teeth along the side edges of the holding member do not engage the cylindrical object.

The safety device may be incorporated into the ladder in a number of ways. The first includes providing a means for rotatably fastening the holding member to one of the top rungs of the ladder for rotational movement about a longitudinal axis of the rung. In the preferred embodiment, the fastening means comprises a bracket fastened to the holding member. The bracket has a hole for releasably, rotatably gripping the rung. A collar is fastened to the rung and positioned adjacent to the bracket, whereby the bracket is held in a laterally stationary position on the rung.

The second comprises rotatably fastening the holding member to an elongate member, for rotational movement about a longitudinal axis of the elongate member. Means for selectively fastening the elongate member to the side rails of the ladder is provided. In one embodiment, end plates are fastened to the first and second ends of the elongate member. The end plates have a plurality of holes through which screws may be inserted to fasten the end plates to the side rails. In the preferred embodiment, the elongate member is telescoping, to provide for attachments to ladders having varying widths between the side rails.

The third manner includes incorporating the safety device directly into the ladder. The holding member is rotatably attached to the top rung of the ladder, for rotational movement about a longitudinal axis of the rung.

DETAILED DESCRIPTION OF THE INVENTION

Figure 1:
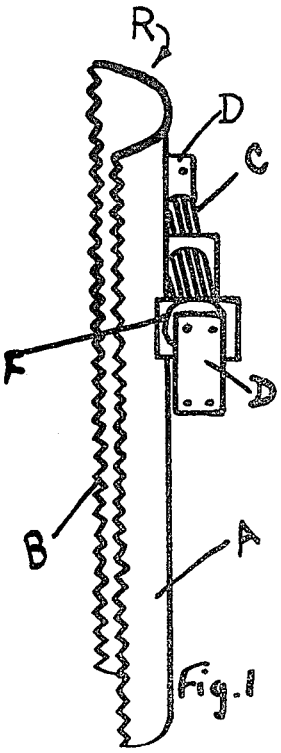
FIG. 1 is a perspective view taken generally from in front and on top showing one embodiment of the present invention.
Figure 2:
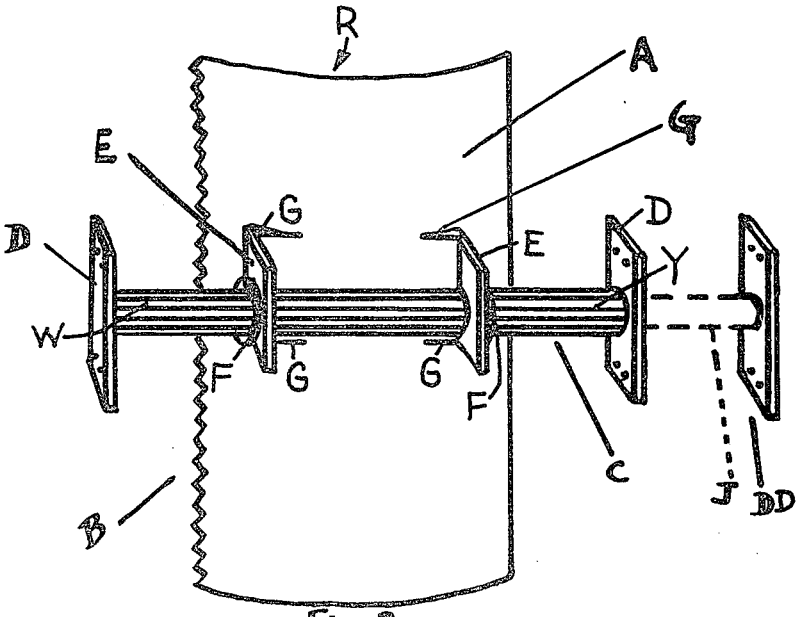
FIG. 2 is a perspective view of the present invention shown in FIG. 1 taken generally from the side and rear.

Referring to the Figures, wherein like letters represent like parts throughout the several views, there is generally illustrated at R in FIGS. 1 and 2 a safety device for a ladder. The ladder has a pair of spaced side rails I joined by spaced rungs L. The safety device R has a holding member A. Means for gripping a cylindrical object is connected to the holding member A in a manner wherein the gripping means is disposed to lie generally perpendicular to the rung. In a preferred embodiment, the holding member A is a rigid arcuate shaped plate having a top, bottom and two side edges and its length greater than its width. The plate is curved generally along a longitudinal axis of the holding member, having a convex shape facing the rung. A plurality of sharp pointed teeth B are disposed along the side edges. While the holding member A is shown as a rigid solid plate, it is understood that other configurations would also be functional. One such example (not shown) would be a holding member A that is in the general shape of the letter "H". Such a holding member has a first and second gripping member being oppositely disposed and has a support member having a first end fastened to the first gripping member and a second end fastened to the second gripping member, thereby connecting said gripping members. The gripping means would be attached longitudinally to the first and second gripping members.

Figure 5:
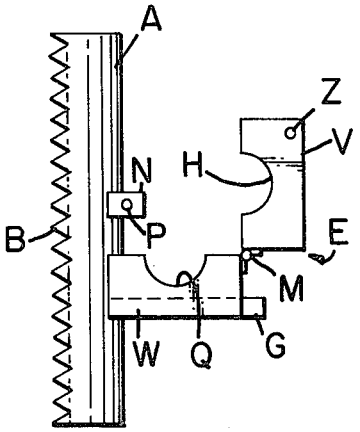
FIG. 5 is a view in side elevation showing another embodiment of the present invention.
Figure 6:
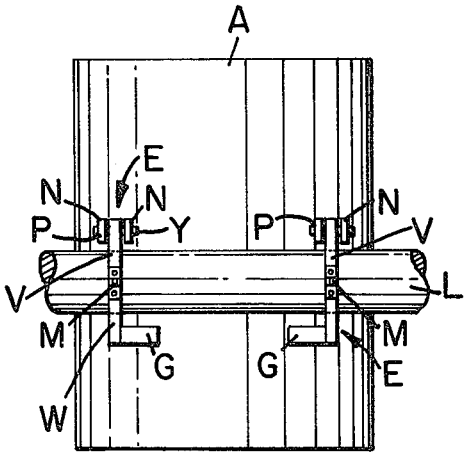
FIG. 6 is a view in front elevation of the present invention as shown in FIG. 6.

In one embodiment as shown in FIGS. 5 and 6, the holding member A is rotatably fastened to the rung L of the ladder for rotational movement about a longitudinal axis of the rung L. First and second brackets E are cooperatively fastened to the holding member A. The brackets E each defines a hole for rotatably releasably gripping the rung L. The brackets E each comprise a top section V defining a semi-circular opening H and a hole Z and a bottom section W defining a semi-circular opening Q. Bottom section W is cooperatively held to the holding member A by brace G that is connected to bracket E and holding member A. One method of connecting the brace G is to weld the brace G to the bracket E and holding member A. Top section V is pivotally connected to bottom section W by hinge M. As shown in FIG. 5, the sections V and W open to encircle the rung L and then, as shown in FIG. 6, close to securely grip the rung L. When closed, the top section V is positioned between two tabs N each defining a hole P. Tabs N are secured to the holding member A. Pin Y is inserted through holes P and Z to secure the top section V to the holding member A. It is understood that any suitable means of releasably rotatably gripping the rung L may be used. For example, two semi-circular arms pivotally attached to holding member A may also be used. As shown in FIG. 2, a first collar F is fastened to the rung L and positioned adjacent to one side of the first bracket E between end plate D and bracket E. A second collar F is positioned adjacent to one side of the second bracket E between end plate D and bracket E, whereby the brackets E are held in a laterally stationary position on the rung L. One method of fastening the collar F is to insert a set screw through the collar F to engage the rung L.

In another embodiment, the holding member A is rotatably fastened to an elongate member C for rotational movement. First and second brackets E are cooperatively fastened to the holding member A. Brackets E are held secure to the holding member A by braces G that are connected to brackets E and holding member A. A portion of the elongate member C is positioned within a hole in the brackets E, thereby rotatably fastening the holding member A to the elongate member C. Similar to the previous embodiment, first and second collars F are fastened to the elongate member C and positioned adjacent to the bracket E, thereby holding the bracket E in a laterally stationary position on the elongate member C. The collar F may also be welded to the elongate member C. The elongate member C is selectively fastenable to the side rails I of a ladder and generally parallel to the rungs. A first end plate D is fastened to a first end W of the elongate member C. A second end plate D is fastened to a second end Y of the elongate member C. The end plates D have a plurality of holes through which a fastening member such as a screw, may be inserted to selectively fasten the end plate to the side rail I of the ladder. In a preferred embodiment, the elongate member C has a telescoping member J. A first end plate D is fastened to a first end W of the elongate member C. The elongate member C has an internal cavity having an opening to a second end Y of the elongate member C. A second end plate DD is fastened to a first end of the telescoping member J. In this embodiment an end plate D is not fastened to the second end Y. The second end of the telescoping member J is sized to be inserted through the second end Y of the elongate member C into the internal cavity. Telescoping member J is slidable within the internal cavity. As shown in phantom in FIG. 2, the telescoping member J may be partially removed from the internal cavity to increase the combined length of the elongate member C and the telescoping member J, whereby the safety device R is easily fastenable to a variety of ladders that have a different distance between the side rails I.

In another embodiment, the safety device is an integral portion of the ladder. The holding member A is rotatably fastened to one of the rungs in a similar manner that the holding member A was fastened to the elongate member C in the preceeding embodiment.

If the top end of the holding member A extends beyond the top of side rails I, the ladder can not readily be used against a flat surface. This is because the ladder would rest against a flat surface by the top of the holding member A and not the top of the side rails I. Therefore, it is preferable to mount the safety device R to the ladder, such that the top end of the holding member A is below the top of the side rails I.

Figure 3:
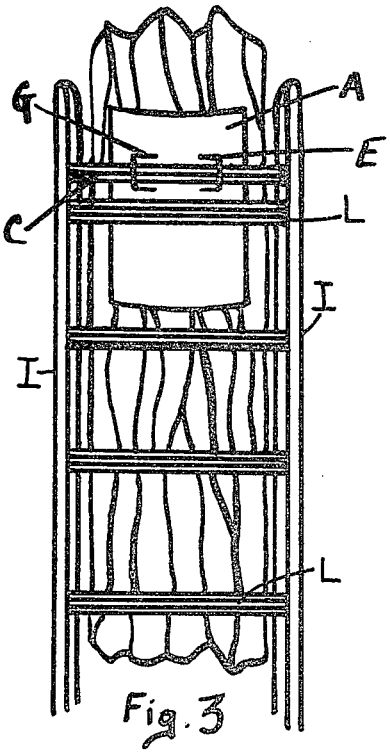
FIG. 3 is a rear view of the present invention shown in FIG. 1 attached to a ladder.
Figure 4:
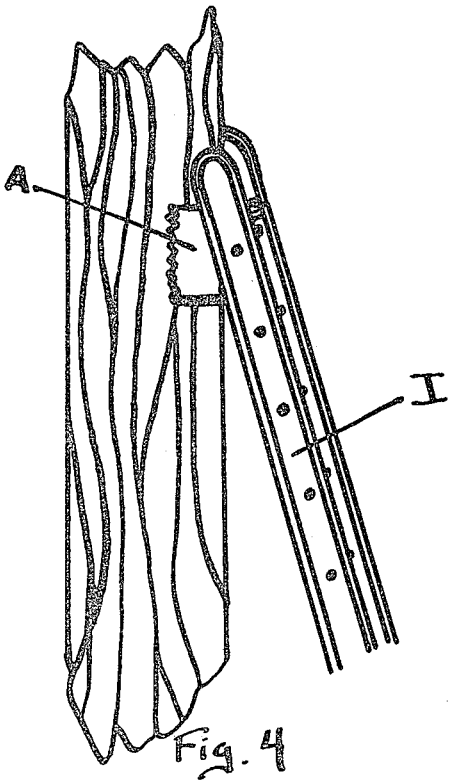
FIG. 4 is a perspective view of the present invention shown in FIG. 3 taken generally from the side and top.

In operation as shown in FIGS. 3 and 4, when the safety device is attached to or an integral part of a ladder, the safety device will stabilize a ladder when it is placed against poles or trees of varying diameter. If the safety device is placed against a pole having a diameter less than the distance between the gripping means, the arcuately shaped holding member will come in conforming engagement with the pole. When the pole or tree to be gripped has a diameter greater than the distance between the gripping members, the sharp pointed teeth connected to the holding member A engage the pole along a length generally parallel to a longitudinal axis of the pole. The engagement along a length generally parallel to a longitudinal axis of the pole provides for increased stability of the ladder. Unlike other safety devices, the present invention will securely grip a tree or pole having a diameter greater than the distance between the side rails I of the ladder.

Other modifications of the invention will be apparent to those skilled in the art in light of the foregoing description. This description is intended to provide specific examples of individual embodiments which clearly disclose the present invention. Accordingly, the invention is not limited to those embodiments or to the use of elements having the specific configurations and shapes as presented herein. All alternative modifications and variations of the present invention which fall within the spirit and broad scope of the appended claims are included.

I claim:

1. A safety device for a ladder having a pair of spaced side rails joined by spaced rungs, said safety device comprising:

(a) a holding member;

(b) means for rotatably fastening said holding member to the rung of the ladder, for rotational movement about a longitudinal axis of the rung; and (c) means for gripping a cylindrical object, said gripping means connected to said holding member in a manner wherein said gripping means is disposed to lie generally perpendicular to the rung, whereby when the ladder is placed against a vertically positioned cylindrical object, said gripping means engage the cylindrical object along a length generally parallel to a longitudinal axis of the cylindrical object.

2. The safety device of claim 1, wherein said holding member is arcuately shaped, curved generally along a longitudinal axis of said holding member, having a convex shape facing the rung, for conforming engagements with the cylindrical object.

3. The safety device of claim 1, wherein said fastening means comprises:

(a) a bracket cooperatively fastened to said holding member, said bracket defining a hole for releasably, rotatably gripping the rung; and (b) a collar fastened to the rung and positioned adjacent to said bracket, whereby said bracket is held in a laterally stationary position on the rung.

4. The safety device of claim 1, wherein said gripping means comprises a plurality of sharp, pointed teeth.

5. The safety device of claim 1, wherein said holding member comprises:

(a) a first and second gripping members, said gripping members being oppositely disposed and having a plurality of sharp, pointed teeth along substantially their entire length;

(b) a support member having a first end fastened to said first gripping member and a second end fastened to said second gripping member, thereby connecting said gripping members.

6. The safety device of claim 5, wherein the support member is arcuately shaped, curved generally along a longitudinal axis of said holding member, having a convex shape facing the rung, for conforming engagement with the cylindrical object.

7. A safety device for a ladder having a pair of spaced side rails joined by spaced rungs, said safety device comprising:

(a) a holding member;

(b) an elongate member;

(c) means for rotatably fastening said holding member to said elongate member, for rotational movement about a longitudinal axis of said elongate member;

(d) means for selectively fastening said elongate member to the side rails generally parallel to the rungs; and (e) means for gripping a cylindrical object, said gripping means connected to said holding member in a manner wherein said gripping means is disposed to lie generally perpendicular to said elongate member whereby when the ladder is placed against a vertically positioned cylindrical object, said gripping means engage the cylindrical object along a length generally parallel to a longitudinal axis of the cylindrical object.

8. The safety device of claim 7, wherein said holding member is arcuately shaped curved generally along a longitudinal axis of said holding member, having a convex shape facing said elongate member, for conforming engagement with the cylindrical object.

9. The safety device of claim 7, wherein said fastening means comprises:

(a) a bracket cooperatively fastened to said holding member, said bracket defining a hole, a portion of said elongate member being positioned within said hole and said bracket being rotatable about a longitudinal axis of said elongate member; and (b) a collar fastened to said elongate member and positioned adjacent to said bracket, whereby said bracket is held in a laterally stationary position on said elongate member.

10. The safety device of claim 7, wherein said gripping means comprises a plurality of sharp, pointed teeth.

11. The safety device of claim 7 wherein said holding member comprises:

(a) a first and second gripping members, said gripping members being oppositely disposed and having a plurality of sharp, pointed teeth along substantially their entire length;

(b) a support member having a first end fastened to said first gripping member and a second end fastened to said second gripping member, thereby connecting said gripping members.

12. The safety device of claim 7, wherein said support member is arcuately shaped curved generally along a longitudinal axis of said holding member, having a convex shape facing said elongate member, for conforming engagement with the cylindrical object.

13. The safety device of claim 7, wherein said elongate member is telescoping.

14. A ladder comprising:

(a) a pair of spaced side rails;

(b) a plurality of spaced rungs, said side rails joined by said rungs;

(c) a holding member;

(d) means for rotatably fastening said holding member to one of said rungs for rotational movement about a longitudinal axis of said one of said rungs;

(e) means for gripping a cylindrical object, said gripping means connected to said holding member in a manner wherein said gripping means is disposed to lie generally perpendicular to the rung whereby when the ladder is placed against a vertically positioned cylindrical object, said gripping means engage the cylindrical object along a length generally parallel to a longitudinal axis of the cylindrical object.

15. The ladder of claim 14, wherein said holding member is arcuately curved generally along a longitudinal axis of said holding member, having a convex shape facing said rungs, shaped for conforming engagement with the cylindrical object.

16. The ladder of claim 14, wherein said fastening means comprises:

(a) a bracket cooperatively fastened to said holding member, said bracket defining a hole for rotatably gripping said one of said rungs; and (b) a collar fastened to said one of said rungs and positioned adjacent to said bracket, whereby said bracket is held in a laterally stationary position on said one of said rung.

17. The ladder of claim 14, wherein said gripping means comprises a plurality of sharp, pointed teeth.

18. The ladder of claim 14, wherein said holding member comprises:

(a) first and second gripping members, said gripping members being oppositely disposed and having a plurality of sharp, pointed teeth along substantially their entire length; and (b) a support member having a first end fastened to said first gripping member and a second end fastened to said second gripping member, thereby connecting said gripping members.

19. The ladder of claim 18 wherein said support member is arcuately curved generally along a longitudinal axis of said holding member, having a convex shape facing said rung shaped for conforming engagement with the cylindrical object.

20. A safety device for a ladder having a pair of spaced side rails joined by spaced rungs, said safety device comprising:

(a) a rigid arcuately shaped holding member, curved generally along a longitudinal axis of said holding member, having a convex shape facing the rung, having a length greater than a width; and (b) means for rotatably fastening said holding member to the rung of the ladder, for rotational movement about a longitudinal axis of the rung, whereby when the ladder is placed against a vertically positioned cylindrical object, said holding member engages the cylindrical object along a length generally parallel to a longitudinal axis of the circular object.

21. A safety device for a ladder having a pair of spaced side rails joined by spaced rungs, said safety device comprising:

(a) an arcuately shaped plate having a top, bottom and two side edges, said plate being curved generally along a longitudinal axis of said holding member, having a convex shape facing the rung;

(b) means for rotatably fastening said plate to one of the rungs of the ladder, for rotational movement about a longitudinal axis of the rung; and (c) a plurality of sharp, pointed teeth disposed along said side edges, whereby when the ladder is placed against a vertically positioned cylindrical object, said teeth engage and grip the cylindrical object along a length generally parallel to a longitudinal axis of the cylindrical object.

* * * * *